US006899244B2

(12) United States Patent
Takayama

(10) Patent No.: US 6,899,244 B2
(45) Date of Patent: May 31, 2005

(54) BEVERAGE CONTAINER

(76) Inventor: Yoshikazu Takayama, 19-5, Otsuka 5-chome, Bunkyou-ku, Tokyo (JP)

( * ) Notice: Subject to any disclaimer, the term of this patent is extended or adjusted under 35 U.S.C. 154(b) by 146 days.

(21) Appl. No.: 10/221,976

(22) PCT Filed: Jan. 16, 2002

(86) PCT No.: PCT/JP02/00242

§ 371 (c)(1),
(2), (4) Date: Jan. 21, 2003

(87) PCT Pub. No.: WO02/057155

PCT Pub. Date: Jul. 25, 2002

(65) Prior Publication Data

US 2003/0146217 A1 Aug. 7, 2003

(30) Foreign Application Priority Data

Jan. 18, 2001 (JP) ..... 2001-10823

(51) Int. Cl.[7] ..... B65D 17/00

(52) U.S. Cl. ..... 220/257.2; 220/359.2; 220/906

(58) Field of Search ..... 220/906, 257.2, 220/716, 814, 359.1, 359.2; 206/807

(56) References Cited

U.S. PATENT DOCUMENTS

| | | | | |
|---|---|---|---|---|
| 4,679,693 | A | 7/1987 | Forman | |
| 4,837,061 | A | 6/1989 | Smits | |
| 4,927,048 | A | 5/1990 | Howard | |
| 5,873,483 | A | 2/1999 | Görtz | |
| 5,904,259 | A | 5/1999 | Hidding | |
| 6,321,927 | B2 * | 11/2001 | Cavella | 220/359.2 |
| 6,378,718 | B1 * | 4/2002 | Maggi et al. | 220/257.1 |
| 6,443,323 | B1 * | 9/2002 | DeRose | 220/257.1 |

FOREIGN PATENT DOCUMENTS

| | | |
|---|---|---|
| AU | B-20593/88 | 2/1989 |
| AU | B-72918/87 | 7/1989 |
| AU | B-64156/90 | 4/1991 |
| AU | B-42774/96 | 7/1996 |
| CA | 1305685 | 7/1992 |
| CA | 1316128 | 4/1993 |
| CN | 97104690.5 | 2/1998 |
| DE | 3927466 | 11/1991 |
| DE | 3885195 | 2/1994 |
| DE | 69029272 | 3/1997 |
| DE | 69515330 | 7/2000 |
| EP | 0249337 | 12/1987 |
| EP | 0303400 | 2/1989 |
| EP | 0816283 | 1/1998 |
| GB | 2314828 | 1/1998 |
| JP | 64-70791 | 3/1989 |
| JP | 10-510786 | 10/1998 |
| JP | 2000-327016 | 11/2000 |
| KR | 95-10032 | 9/1995 |
| KR | 98-9053 | 4/1998 |
| MX | 012588 | 3/1993 |
| SE | 505294 | 7/1997 |
| WO | WO 89/11421 | 11/1989 |
| WO | WO 91/04199 | 4/1991 |
| WO | WO 96/18555 | 6/1996 |

* cited by examiner

*Primary Examiner*—Jacob K. Ackun, Jr.
(74) *Attorney, Agent, or Firm*—Frommer Lawrence & Haug LLP; William S. Frommer

(57) ABSTRACT

The tampering work can be easily detected by using the seal for sealing of a drink/food container. By providing an unseal confirmation member of which the condition changes when adhesive seal member 8A, 46A of seal for sealing 8, 46 provided on the drink/food container 1, 40 is reattached after being peeled once, the user can confirm at first sight that the drink/food container has been used.

5 Claims, 11 Drawing Sheets

BEVERAGE CONTAINER

TECHNICAL FIELD

The present invention relates to a drink/food container, especially to a drink/food container for protecting against tampering.

BACKGROUND ART

Heretofore, as for drink containers, can-type drink containers filled with alcohol such as beer, soft drinks such as sports drink, and beverages such as coffee have been sold on the market. Typically, a user who bought such a drink opens a drinking mouth provided on the drink container by hand and drinks the liquid flowing out from the opened drinking mouth by putting his mouth to the vicinity of said drinking mouth.

Such a can-type container is inconvenient because its drinking mouth cannot be closed again if it is opened once, and it may be not clean for the user to put his mouth directly to the drinking mouth. Therefore, a method to provide removable seal on the upper surface of the drink container has been proposed (Japan Patent Laid-open No. H9-48449 Bulletin).

Such a drink container having a seal around its drinking mouth has an advantage because even if it is opened once, the drinking mouth can be resealed, resulting in effectively preventing the spill of liquid contained in the container from the drinking mouth and the uncleanness around the drinking mouth to which the user's mouth directly touches. On the other hand, there is a possibility of occurrence of the secondary accident due to illegally using a used product which was opened once and then returned to the original condition (hereinafter referred to as tampering) so as to look like an unused new product.

Furthermore, providing a similar seal which can be reattached after being peeled off, on the upper part of the can-type container is convenient for users but there is a possibility of the occurrence of the secondary accident.

DESCRIPTION OF THE INVENTION

The present invention has been made considering the above points, and is proposing a drink/food container capable of eliminating the possibility of illegal use by leaving the evidence as the used product.

To obviate such problems, in the present invention, an adhesive seal member 8A for covering a drinking mouth cover part 7 which is to be opened by a drinking mouth opener 4 and unseal confirmation members 11A, 11B, 15, 21, 25, 30A, 30B for showing the used condition by changing their appearances are provided on the surface of the container main body 2.

Furthermore, a seal for sealing 46 for covering the upper part of the container main body 41 is provided. This seal for sealing 46 is to be opened together with an upper surface plate when the upper surface plate 42 is opened along the unseal cutting slit 45 by an opener 44. And simultaneously, the fringe of the upper surface plate 42 is covered by the fringe folded part 46A1, and when the upper surface plate 42 is returned covering the unseal cutting slit 45, the fringe folded part 46A1 is reattached to the fringe of the container main body 41.

If the adhesive seal member 8A, 46A is peeled off once, the sticking condition to the back surface of the container main body 2, 41 is changed. And thus, unseal confirmation members 11A, 11B, 15, 21, 25, 30A, 30B, 49 are in used conditions which can be easily confirmed from the outside.

BEST MODE FOR CARRYING OUT THE INVENTION

With reference to the accompanying figures one embodiment of the present invention will be described.

(1) The First Embodiment

Figure 1:
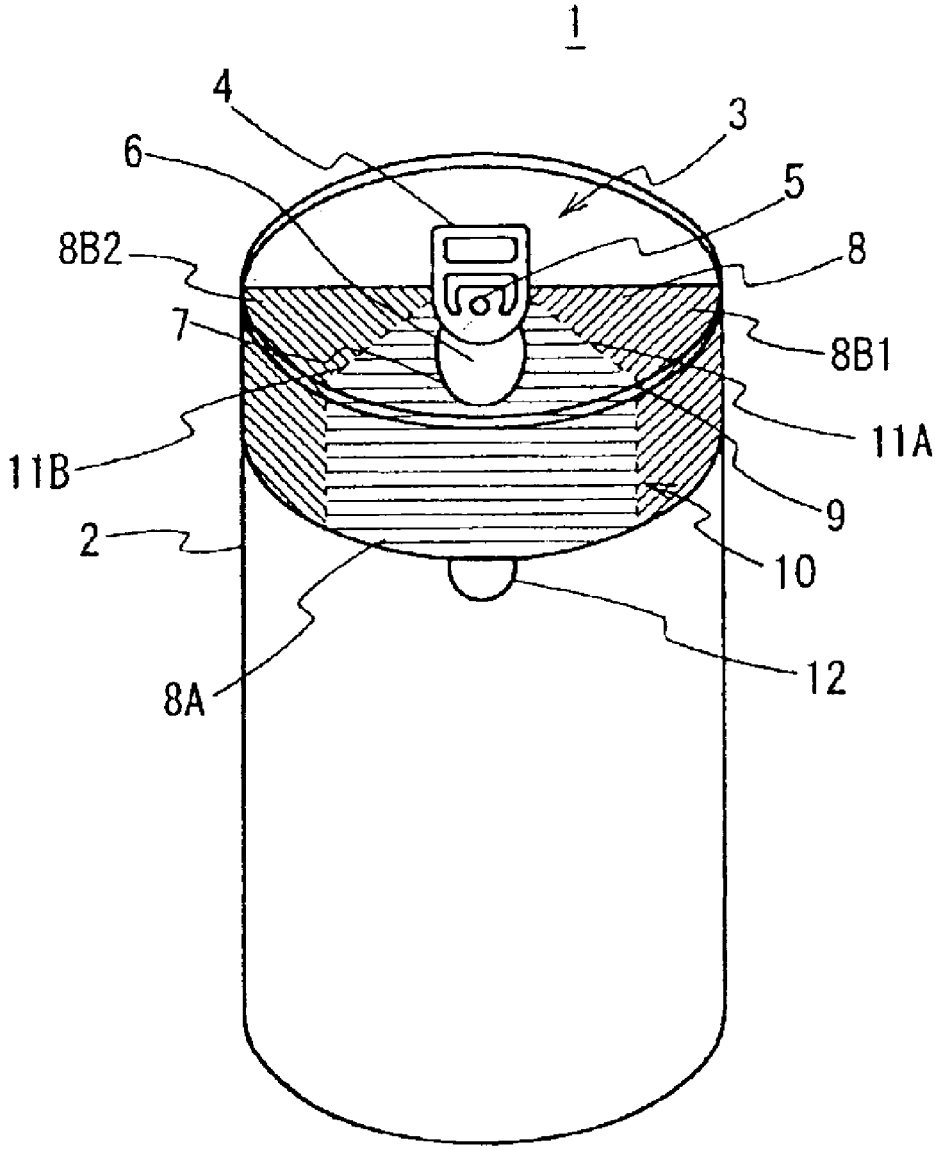
FIG. 1 is a perspective view showing a drink container of the first embodiment according to the present invention.

In FIG. 1, reference numeral 1 generally shows a can-type drink container, and a drinking mouth opener 4 is provided nearly in the center of the upper surface plate 3 of the cylindrical container main body 2 of which both edges are closed.

The drinking mouth opener 4 is fixed to one edge of the drinking mouth cover 6 by a grommet 5. And when the tip of this drinking mouth opener 4 is pulled up by the user's finger, the drinking mouth cover 6 is pivotally pulled down with the grommet 5, so that the drinking mouth cover 6 is folded in the container main body 2. And thus, the drinking mouth 7 formed inside the fringe of the drinking mouth cover 6 is opened. With this arrangement, liquid contained in the container main body 2 can be flown out from the drinking mouth 7.

A seal for sealing 8 is provided between the drinking mouth opener 4 and the upper surface plate 3 on the surface of the upper face plate 3 to cover the drinking mouth cover 6.

In the case of this embodiment the seal for sealing 8 covers from the center of the upper surface plate 3 over the fringe projecting part 9 on the drinking mouth 7 side, toward the side surface plate part 10 of the container main body 2. Thus, the seal for sealing 8 covers nearly the half-circle part of the round upper surface plate part 3 and the semicircle part of the upper side surface part 10 of the container main body 2. With this arrangement, the part to which the user's mouth touches when he drinks liquid and its peripheral part are not exposed.

The seal for sealing 8 is made of transparent synthetic resins having elasticity so that it is not be broken by the pushing edge of the drinking mouth opener 4 when the tip is pulled up to pull down the drinking mouth cover 6. Thereby, when the drinking mouth 7 is opened by the opening operation of the drinking mouth opener 4, the seal for sealing 8 remains as it is covering the drinking mouth 7.

On the upper surface plate 3 of the seal for sealing 8, two perforations 11A and 11B which look like a fan are cut in with the drinking mouth 7 as a center, and the perforations 11A and 11B are cut in nearly straight to the lower side edge of the seal for sealing 8, crossing over the fringe projecting part 9.

Adhesive glue is applied to the back surfaces of the fan-shaped part surrounded by perforations 11A and 11B of the seal for sealing 8 excluding the part facing to the drinking mouth cover 6, and the adhesive seal part 8A is thus formed. As a result, the adhesive seal part 8A of the seal for sealing 8 can be peeled off from the container main body 2, and the adhesion of glue can realize the reattachment of the adhesive seal part 8A peeled off, on the container main body 2.

At this point, the "adhesion" implies such a sticking condition that the seal for sealing 8 can be reattached on the container main body 2 after being temporarily peeled off from the container main body 2 in a state where the seal for sealing 8 is affixed on the container main body 2.

On the other hand, the cohesive glue is applied to the back surface of cohesive parts 8B1 and 8B2 which are remaining parts on both sides of the adhesive seal part 8A. And thus, the cohesive parts 8B1 and 8B2 are fixed to the container main body 2 with strong adhesion.

This "cohesion" implies such a sticking condition that the seal for sealing 8 is stuck strongly when it is affixed on the container main body 2, and when it is peeled off from the container main body 2, its adhesion is lost.

Thus, when the user peels off the adhesive seal part 8A of the seal for sealing 8 from the upper side surface plate 10 after opening the drinking mouth 7 by the opening operation of the drinking mouth opener 4, the adhesive seal part 8A is torn off from the cohesive parts 8B1 and 8B2 along perforations 11A and 11B of both sides and peeled off upward. Thus, the drinking mouth 7 is released from the condition being covered by the seal for sealing 8, so that liquid contained in the container main body 2 can be flown out.

Then, the adhesive seal part 8A can be reattached on the container main body 2 with its stickiness of the glue applied to its back surface, by being pressed onto the container main body 2.

A half-circular knob 12 is provided projecting at the tip of the side surface plate 10 side of the adhesive seal part 8A. Thus, the user, by picking and pulling up this knob 12 by his finger, the adhesive seal part 8A can be peeled off from the container main body 2. As a result, the adhesive seal part 8A is turned up, excepting for its upper edge part.

Figure 2:
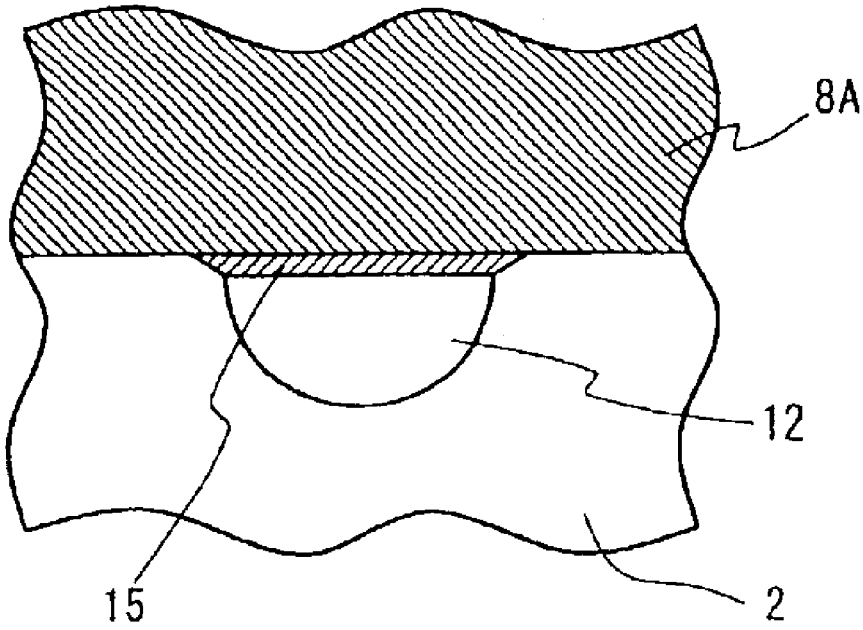
FIG. 2 is a fragmentary enlarged front diagram showing an unseal confirmation part attached to the adhesive seal part of FIG. 1.

In addition to the foregoing arrangement, as shown in FIG. 2, an unseal confirmation part 15 is provided on the border from which the knob 12 of the adhesive seal part 8A projects, and weak viscosity glue is applied onto the back side of the unseal confirmation part 15. When the adhesive seal part 8A has not been peeled off, that is, in the initial condition, it has adhesion to the container main body 2. On the other hand, if the adhesive seal part 8A is torn off from the container main body 2 with the knob 12, the unseal confirmation part 15 cannot be stuck again to the container main body 2.

This weak viscosity means such an unsticking condition to the container main body 2 if it is peeled off once from the container main body 2 while being attached to the container main body 2.

According to the foregoing arrangement, when a drink container 1 in unused condition is shipped from the factory, the drinking mouth 7 is closed by its drinking mouth cover 6, and the container main body 2 is covered by the adhesive seal part 8A and cohesive parts 8B1 and 8B2 which are connected to each other via perforations 11A and 11B.

Under such conditions, when a user opens the drinking mouth 7 with the drinking mouth opener 4 by tearing off the adhesive seal part 8A along perforations 11A and 11B, the drinking mouth 7 is exposed and then the user can drink the liquid by touching his mouth in the vicinity of drinking mouth 7.

At this point, since the adhesive seal part 8A is stuck to the vicinity of the drinking mouth 7 of the container main body 2 immediately before the user drinks the liquid, the drinking mouth 7 can maintain a clear condition.

If the adhesive seal part 8A is reattached if the liquid remains in the container main body 2 in the middle of used condition, the liquid remaining inside is held in a state not being flown out by the adhesive seal part 8A covering the drinking mouth 7.

However, since the perforations 11A and 11B as the border line between the adhesive seal part 8A and the cohesive parts 8B1 and 8B2 has been torn off after a part of the container was used, a mark showing that the drink container 1 was used once can be clearly left behind.

Further, when the knob 12 is pulled up once to peel off the adhesive seal part 8A, the unseal confirmation part 15 is also torn off from the container main body 2 and then can not stick because of its weak viscosity. Thereby, the mark showing that a part or all of the adhesive seal part 8A has been peeled off can be clearly left.

According to the foregoing arrangement, if the unseal confirmation part 15 in a state not sticking to the container main body 2 can be confirmed when the perforations 11A and 11B are torn off, the fact that the drink container 1 was used once can be easily confirmed. Thus, the occurrence of the secondary accident caused by tampering to the drink container 1 can be easily prevented.

(2) The Second Embodiment

Figure 3:
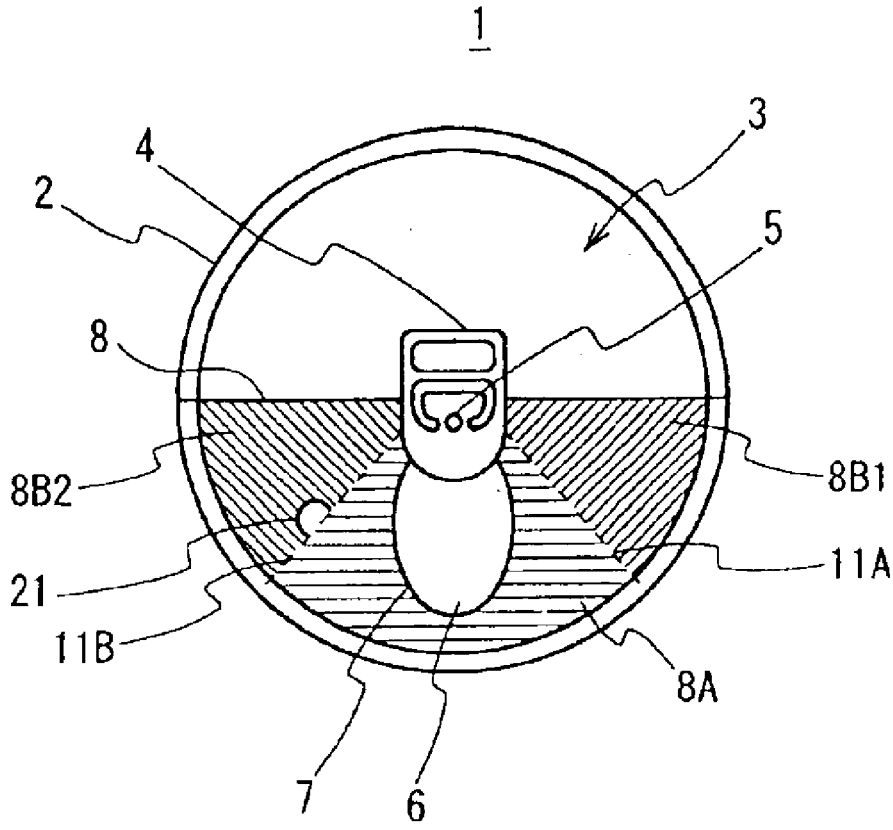
FIG. 3 is a plane diagram showing the second embodiment of a drink container according to the present invention.

FIG. 3 shows the second embodiment, and as shown in FIG. 3 in which corresponding parts of FIG. 1 are given the same reference numerals, a semicircular unseal confirmation part 21 is provided on one or both sides of perforations 11A and 11B (in the case of this embodiment one perforation 11B) which are provided as the borders of cohesive parts 8B1 and 8B2 of the seal for sealing 8 and the adhesive seal part 8A on the upper surface plate 3 of the container main body 2.

Figure 4:
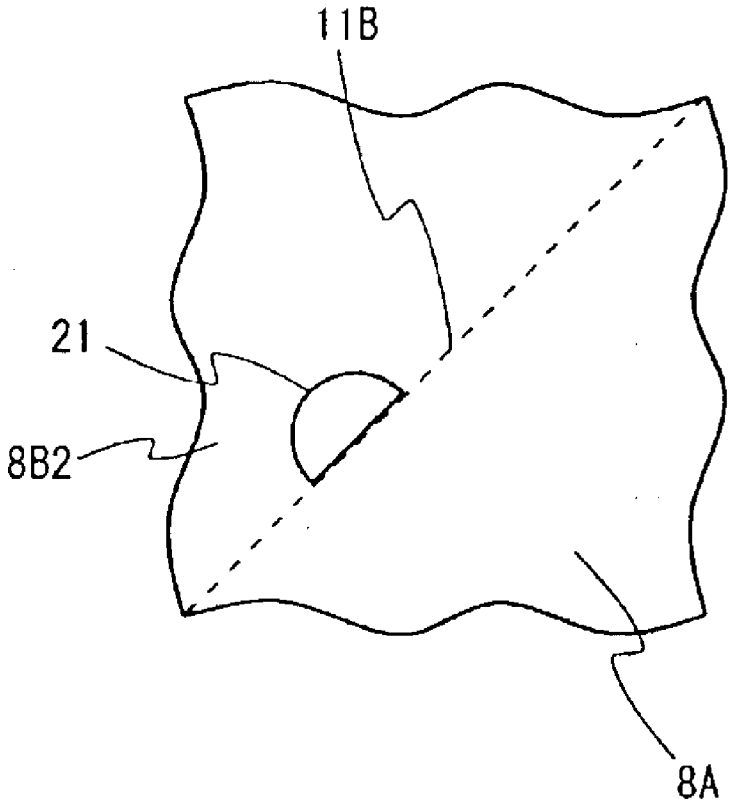
FIG. 4 is a fragmentary enlarged plane diagram showing an unseal confirmation part of FIG. 3.

In this case, as to the unseal confirmation part 21, as shown in FIG. 4, the back surface of the cohesive part 8B2 has a semi-circular non-cohesive area from the perforation 11B on the cohesive part 8B2 side, to which cohesive glue is not applied, and this area is referred to as the unseal confirmation part 21.

According to the foregoing arrangement, when the drink container 1 has not been used, the seal for sealing 8 placed on the upper surface plate 3 of the container main body 2 looks like as if its overall surface sticks flatly on the upper surface plate part 3.

More specifically, the cohesive parts 8B1 and 8B2 of the seal for sealing 8 are stuck onto the respective opposing upper surface plate 3 by glue applied on the back surface in a state these are connected to the adhesive seal part 8A via perforations 11A and 11B. Accordingly, since the adhesive seal part 8A forms one seal for sealing 8 together with the cohesive parts 8B1 and 8B2, generally these are stuck flatly on the upper surface plate 3.

At this point, the unseal confirmation part 21 is not stuck to the upper surface plate 3 since the adhesive is not applied to the back surface of the unseal confirmation part 21. However, since it is connected to the adhesive seal part 8A via the perforation 11B, it becomes the flat condition similar to that of the cohesive part 8B2. Thus, the unseal confirmation part 21 becomes the condition as if it is stuck onto the upper surface plate 3 together with the cohesive part 8B2.

Under such arrangement, if the adhesive seal part 8A is reattached to the upper surface plate 3 after this adhesive seal part 8A is peeled off once, the adhesive seal part 8A is torn off along the perforations 11A and 11B, and thereby only the unseal confirmation part 21 is lifted upward.

In this connection, when the adhesive seal part 8A is reattached so that the adhesive seal part 8A1 and the cohesive part 8B become flat along the border of the perforation 11B, only the unseal confirmation part 21 is deformed by the forceful power because no adhesive exists on the back surface thereof when the perforation 11B is torn off. On the other hand, the cohesive part 8B2 around the unseal confirmation part 21 and the adhesive seal part 8A are stuck onto the upper surface plate 3 and are not be lifted up.

Thus, according to the arrangement of FIG. 3 and FIG. 4, when the adhesive seal part 8A is peeled off once, the unseal confirmation part 21 remains as it is lifted upward. And thus, the sign showing that the adhesive seal part 8A was peeled off is left.

Accordingly if the used drink container 2 of which the adhesive seal part 8A was peeled off is tampered so as to look like an unused product, the occurrence of the secondary accident can be effectively prevented.

(3) The Third Embodiment

Figure 5:
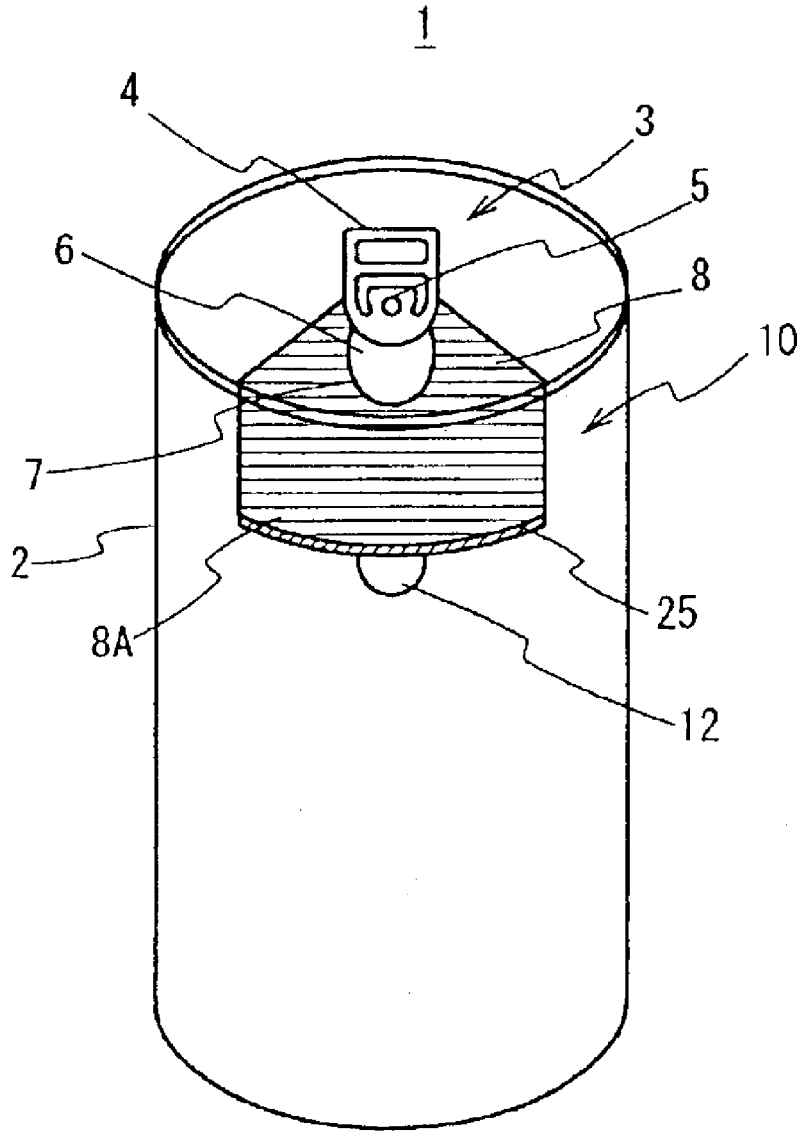
FIG. 5 is a perspective view showing the third embodiment of a drink container according to the present invention.

FIG. 5 shows the third embodiment. As shown in FIG. 5, in which the corresponding parts of FIG. 1 are given the same reference numerals, the seal for sealing 8 comprises only the adhesive seal part 8A, without parts corresponding to the cohesive part 8B1, 8B2, and perforations 11A and 11B of FIG. 1.

In the adhesive seal part 8A, a narrow unseal confirmation part 25 is formed at the edge of the part extending to the side surface of the container main body 2 and the weak viscosity glue is applied to its back surface.

This weak viscosity glue holds the unseal confirmation part 25 stuck onto the container main body 2 under the unused condition before this unseal confirmation part 25 is peeled off. And under such condition, when the unseal confirmation part 25 is peeled off from the container main body 2 once, it becomes the condition unable to stick to the container main body 2.

According to the foregoing arrangement, when the drink container 1 is in the unused condition meaning never been used, the adhesive seal part 8A of the seal for sealing 8 is stuck onto the upper surface plate 3 and the side surface plate 10 of the container main body 2 and also the unseal confirmation part 25 is stuck onto the side surface plate 10.

Under such conditions, when the adhesive seal part 8A is peeled off from the container main body 2 by pulling up a knob 2 and reattached, the adhesive seal part 8A can be stuck onto the container main body 2 by the viscous glue. However, since the weak viscosity glue is applied onto the back surface of the unseal confirmation part 25, it cannot be stuck to the container main body 2 because it loses sticky power after being peeled off.

According to the foregoing arrangement, since the unseal confirmation part 25 can no longer be stuck even when the unseal confirmation part 25 tries to be attached again after the drink container 1 is used once and the adhesive seal member 8A is peeled off, the mark showing that said drink container 1 was used once can be clearly remained by the condition of the unseal confirmation part 25. As a result, the secondary accident caused by tampering to the drink container 1 can be effectively prevented.

(4) The Fourth Embodiment

Figure 6:
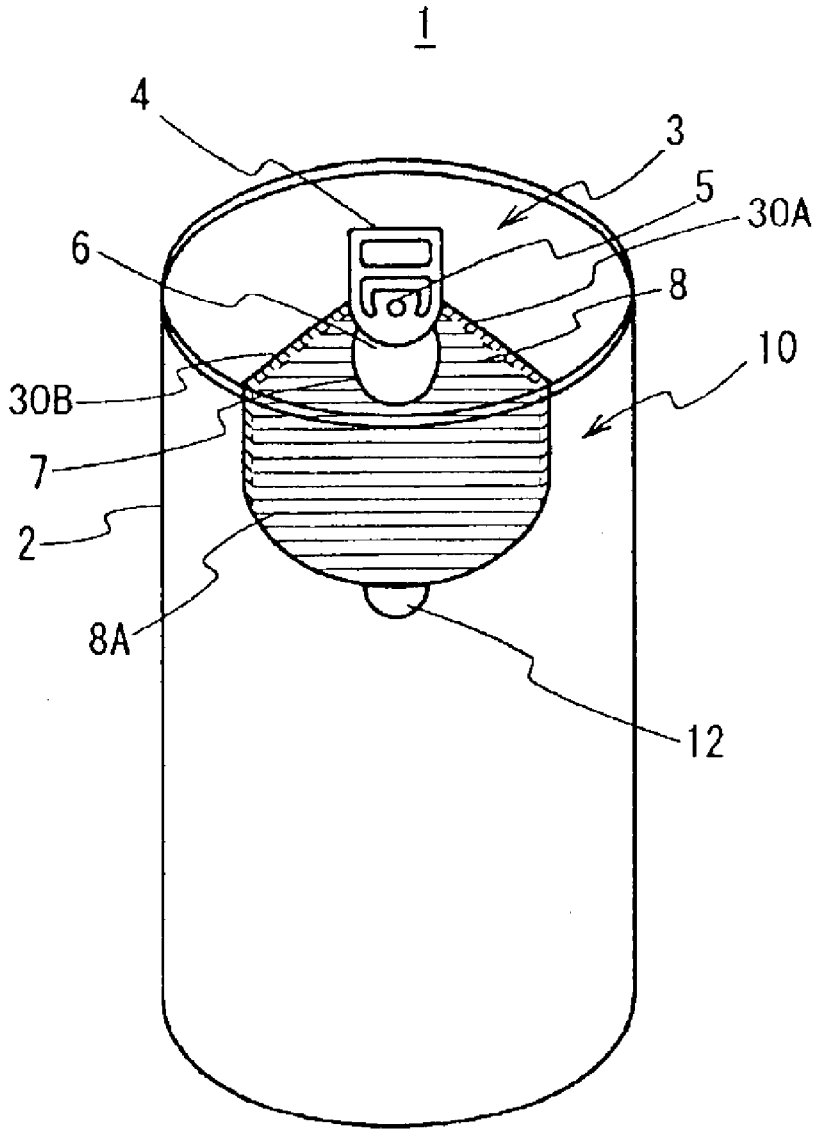
FIG. 6 is a perspective view showing the fourth embodiment of a drink container according to the present invention.

FIG. 6 shows the fourth embodiment. As shown in FIG. 6, in which the corresponding parts of FIG. 5 are designated the same reference numerals, the seal for sealing 8 is formed of an adhesive seal member 8A, and the narrow belt-shaped unseal confirmation parts 30A and 30B are formed on the right and left sides of the adhesive seal part 8A.

Weak viscosity glue is applied to the back surface of the unseal confirmation parts 30A and 30B. Accordingly, when the drink container 1 has not yet been used, the unseal confirmation parts 30A and 30B can maintain their sticking states to the container main body 2. On the other hand, if these are peeled off from the container main body 2, these can not be reattached to the container main body 2.

In the case of this embodiment, the tip part of the adhesive seal part 8A is formed in the tongue-shape, extending downward in the convex shape from the center edge part on which the knob 12 is placed so that its both sides are lifted up as going further to both side edges. Thus, when the adhesive seal part 8A is peeled up by the knob 12, it is peeled off from the narrow area in the vicinity of the knob 12, and thus the initial operation of peeling works can be simplified.

According to the foregoing arrangement, when the drink container 1 is in the unused condition, the adhesive seal part 8A of the seal for sealing 8 is stuck onto the container main body 2, and the unseal confirmation parts 30A and 30B provided on both sides edge parts are stuck to the container main body 2.

Under such conditions, when the knob 12 and the adhesive seal part 8A is reattached after being peeled off, the unseal confirmation parts 30A and 30B placed on both side edges of the adhesive seal part 8A can be no longer reattached. And thus, the user can confirm that the drink container 1 was used at first sight. As a result, the existence of tampering to the drink container 1 can be easily confirmed.

(5) The Fifth Embodiment

Figure 7:
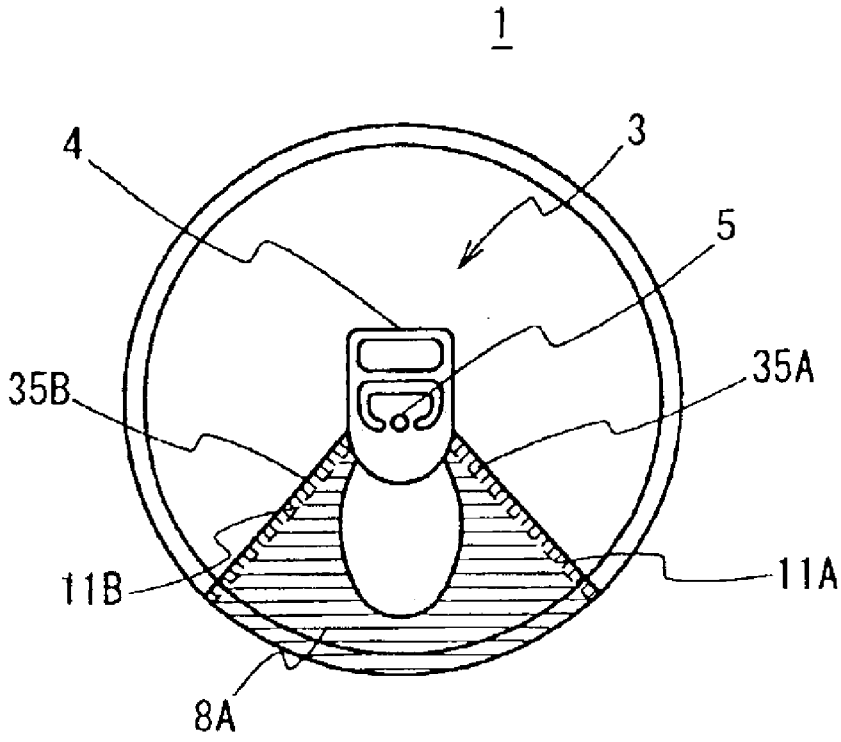
FIG. 7 is a plane diagram showing the fifth embodiment of a drink container according to the present invention.

FIG. 7 shows the fifth embodiment. As shown in FIG. 7, in which the corresponding parts of FIG. 1 are designated the same reference numerals, provided on both sides of the adhesive seal member 8A are cohesive parts 35A and 35B which are narrower than the cohesive parts 8B1 and 8B2 of FIG. 1.

More specifically, the cohesive parts 35A and 35B are formed in narrow and belt-shapes along the outside of perforations 11A and 11B which are provided on both edges of the adhesive seal part 8A, and cohesive glue is applied onto the back surfaces of these cohesive parts 35A and 35B.

According to the foregoing arrangement, when the adhesive seal part 8A is peeled up when the drink container 1 is used, only the adhesive seal part 8 is peeled up while the cohesive parts 35A and 35B firmly attach onto the container main body 2 because perforations 11A and 11B are torn off by the peeling force.

Under such conditions, when the adhesive seal part 8A is reattached on the position adjacent to the cohesive parts 35A and 35B, the adhesive seal part 8A is stuck and held on the container main body 2 by the viscous power of glue applied to the back surface of this adhesive seal part 8A.

At this point, since perforations 11A and 11B are torn off when being used (they are noticeably deformed), the mark that the drink container 1 was used can be clearly left.

Thereby, the possibility of occurrence of the secondary accident can be effectively prevented.

(6) The Sixth Embodiment

Figure 8:
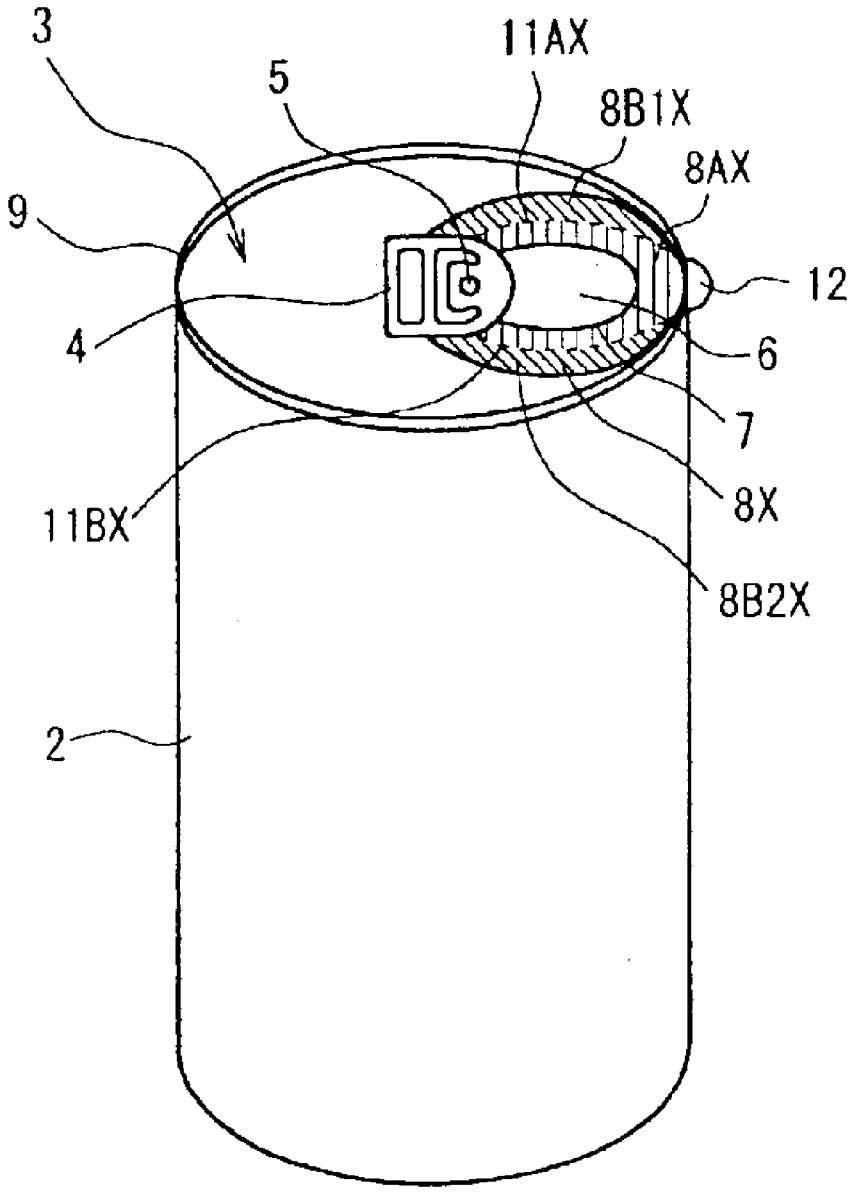
FIG. 8 is a perspective view showing the sixth embodiment of a drink container according to the present invention.

FIG. 8 shows the sixth embodiment. As shown in this FIG. 8, in which the corresponding parts of FIG. 1 are designated the same reference numerals, the shapes and sizes of the adhesive seal part 8AX, cohesive parts 8B1X and 8B2X, and perforations 11AX and 11BX are different from those of FIG. 1.

In the case of FIG. 8, a sealing seal 8X has the shape similar to the shape of fringe part of the drinking mouth 7 on the outer side of the drinking mouth 7, and it is stuck to the upper surface plate 3 of the container main body 2, extending to the fringe projecting part 9.

In the case of this embodiment, the fringe part of drinking mouth 7 is formed nearly in the elliptical shape, and accordingly a drinking mouth cover 6 is formed in the elliptical shape to cover this drinking mouth 7.

Accordingly, cohesive parts 8B1X and B2X are formed in narrow belt-shaped elliptical shape via the elliptically shaped perforations 11AX and 11BX on the outer side of the adhesive seal part 8AX.

Thereby, unlike FIG. 1, in the case of FIG. 8, a knob 12 is provided on the fringe projecting part 9 of the adhesive seal 8AX, not extending the sealing seal 8X on the side surface plate part 10 of the container main body 2.

According to the foregoing arrangement, when the adhesive seal part 8AX is peeled off by pulling up the knob 12 to use the drink container 1, the adhesive seal part 8AX is torn off along the elliptical perforations 11AX and 11BX. Thus, the drinking mouth 7 is exposed under the condition in which the cohesive parts 8B1X and 8B2X are fixed to the upper surface plate 3 of the container main body 2.

Under such conditions if the adhesive seal part 8AX tries to be reattached to the part adjacent to the cohesive parts 8B1X, 8B2X, it is firmly stuck onto the container main body 2 by sticky power of glue applied to its back surface.

At this point, the perforations 11A and 11B are no longer left because these have been torn off for use. Thus, the user can clearly confirm that the drink container 1 was used and the possibility of occurrence of the secondary accident caused by tampering can be effectively prevented.

Also, according to this embodiment, since the size of the sealing seal 8AX can be limited to the minimum size required, the reduction in materials to be used and the simplification in processing work can be realized.

(7) The Seventh Embodiment

Figure 9:
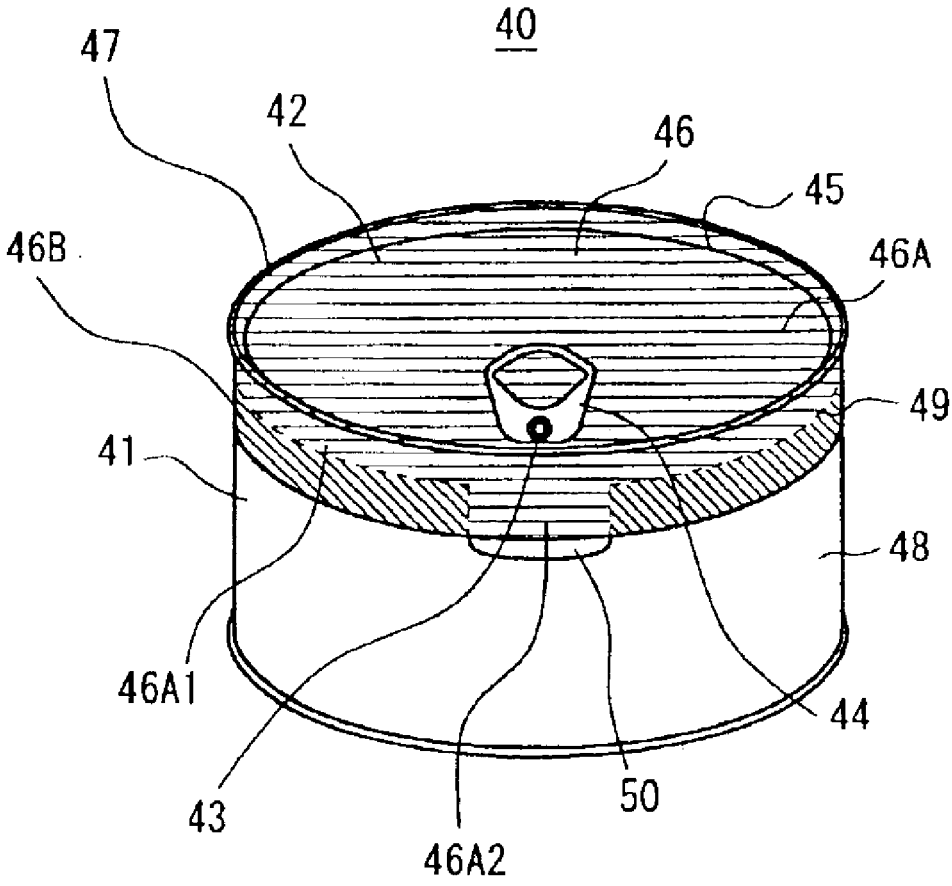
FIG. 9 is a perspective view showing the seventh embodiment of a can container according to the present invention.
Figure 10:
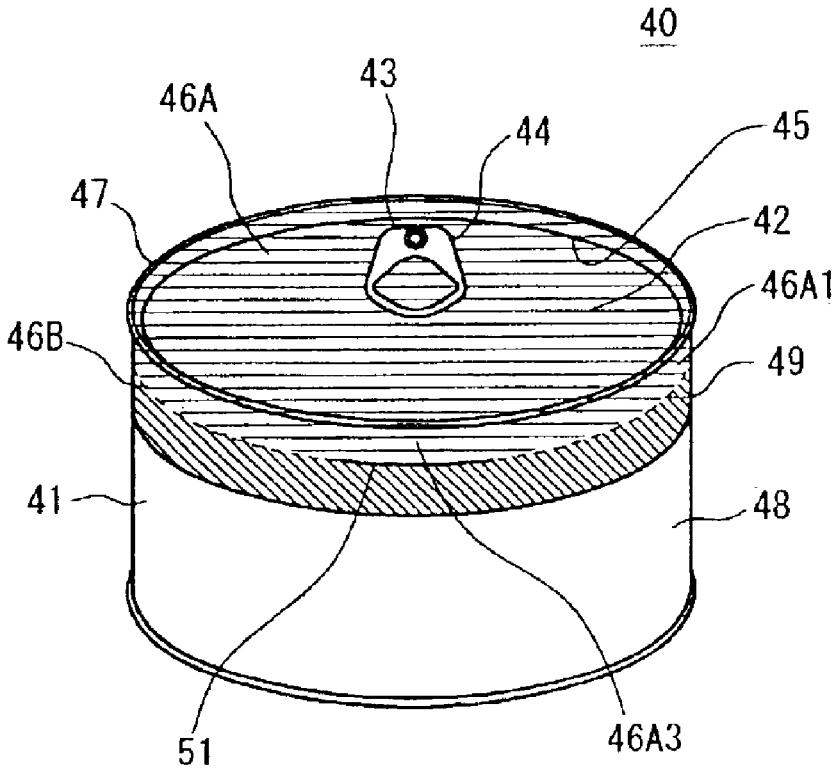
FIG. 10 is a perspective view showing the can container of FIG. 9 seen from the back.

FIGS. 9 and 10 show the seventh embodiment using a seal for sealing 46 in a can container 40. The container main body 41 of the can container 40 is so constructed that one end of the seal opener 44 is fixed onto the upper surface plate 42 by a grommet 43 and the can 40 can be opened when the other end of the seal opener 44 is lifted upward and the upper surface plate 42 is cut out from the container main body 41 on the unseal cutting slit 45 formed on the fringe part of the upper surface plate 42.

The seal for sealing 46 is provided between the upper surface plate 42 of the container main body 41 and the seal opener 44, covers the overall upper edge part of the container main body 41.

The seal for sealing 46 has an adhesive seal part 46A made of transparent synthetic resins having elasticity and adhesive glue is applied onto its back surface. The adhesive seal part 46A is stuck so that the upper edge part of the side surface plate 48 is covered by the fringe crimped part 46A1, crossing over the round upper surface plate 42 and surrounding fringe projecting part 47.

On the side surface plate 48 of the container main body 41, the adhesive seal 46A is extended to the position a little lower from the fringe projecting part 47. And on its lower edge part, the ring belt-shaped cohesive part 46B is provided via the perforation 49.

Furthermore, as shown in FIG. 9, on the side surface plate 48 of the container main body 41, a projecting part 46A2 is provided extending the adhesive seal part 46A cutting across the cohesive part 46B downward in the front surface part where the opener 44 is placed, and a knob 50 is provided in the fringe of its bottom end.

Moreover, as shown in FIG. 10, on the side surface plate 48 of the container main body 41, the rear edge part 46A3 on the opposite side to the position where the opener 44 of the adhesive seal part 46A is arranged, is connected to the cohesive part 46B directly via the border line 51, not via the perforation 49.

According to the foregoing arrangement, when the user opens the unseal cutting slit 45 by lifting up the tip part of the opening tool 44, the grommet 43 of the upper surface plate 42 is pressed down, thereby opening the unseal cutting slit 45.

At the same time, the user, by lifting the knob 50 upward, tears off the adhesive seal part 46A from the cohesive part 46B along the perforation 49 together with the projecting part 46A2.

Thus, when the whole upper surface plate 42 is opened by the unseal cutting slit 45, the adhesive seal 46A is turned up backward with the upper surface plate 42 as being stuck to the upper surface plate 42.

However, on the rear part of the adhesive seal part 46A (FIG. 10), since the perforation is not provided on the rear edge part 46A3 connected to the cohesive part 46B via the border line 51, the rear edge part 46A3 is be torn off but maintains its connecting condition to the cohesive part 46B. Accordingly, the adhesive seal part 46A is opened backward, holding the unsealed upper surface plate 42 attached.

Thus, the can container 40 is opened, so that contents stuffed in the container main body 41 can be taken out from the unseal cutting slit 45.

Under such opening condition, since the adhesive seal part 46A having the upper surface plate 42 stuck thereto folds down, covering the fringe slit of the upper surface plate 42 when the fringe crimped part 46A1 which is attached to the side edge plate part 48 before the opening operation is torn off from the perforation 49, the possibility of the user getting hurt can be effectively prevented by the slit placed of the fringe of the upper surface plate 42.

With this arrangement, in the case of resealing the temporarily opened can container 40 under the condition in which a part of contents remains in the container main body 41, the fringe crimped part 46A1 of the adhesive seal part 46A is reattached to the upper edge side surface of the container main body 41 by returning the upper surface plate 42 back to the position of unseal cutting slit 45.

At this point, since the sticky glue is applied onto the back surface of the adhesive seal part 46A, the tip of the fringe crimped part 46A1 can be stuck touching with the cohesive part 46B. Thus, the contents left in the container main body 41 can be resealed from the outside space.

As a result, the possibility of evaporating the water of contents, smell exhaust, and contrary to these, the possibility of foreign objects mixing into the container main body 41 from the outer space can be prevented.

Thus, when the user opens the upper surface plate 42 once, the seal for sealing 46 is torn off from the cohesive part 46B by the border of perforation 49. Accordingly, if the upper surface plate 42 is returned to the original position and reattached carefully, touching the adhesive seal 46A to the cohesive part 46B, the perforation 49 stays as it is being torn off. And thus, the tampering work can be certainly found at a glance and as a result, the occurrence of the secondary accident can be prevented.

(8) Other Embodiments (8-1) The second embodiment of FIGS. 3 and 4 has dealt with the case of using the semi-circular shape as the shape of the unseal confirmation part 21. However, the shape is not only limited to the semi-circular shape but also the shape can be modified to various shapes. In short, if the mark torn off can be easily confirmed at first sight, any shape can be employed.

(8-2) The first and the seventh embodiments described above have dealt with the cases of not applying glue to the part corresponding to the drinking mouth cover 6 of the upper surface plate 3 in the adhesive seal part 8A. However, viscosity or weak-viscosity glue can be applied instead.

In this case, when the adhesive seal part 8A is peeled off by pulling up the drinking mouth opener 4 and dropping the drinking mouth cover 6 downward, the adhesive seal part 8A is temporarily pulled in the container main body 2. However, as the material for the adhesive seal part 8A, if material having elasticity and strength capable of sustaining the pulling power is used, the adhesive seal part 8A is never broken.

Furthermore, concerning the drink container 1 of which the drinking mouth cover is opened by the opener 4 and returned to the original condition, if the drinking mouth cover 6 can be returned to the original condition after being opened once, the drinking mouth cover 6 returned to the original position can be resealed by the sealing seal 8, 8X.

(8-3) The first to the sixth embodiments (or the seventh embodiment) described above have dealt with the case where the adhesive seal part 8A is made of transparent synthetic resins. However, opaque synthetic resins can be used, instead of the transparent synthetic resins. At this time, transparent material is used only for the drinking mouth cover part 6 so that the condition the drinking mouth cover part 6 drops downward can be confirmed when the drinking mouth opener 4 is operated.

(8-4) Regarding the unseal confirmation part 15 of the first embodiment, the unseal confirmation part 25 of the third embodiment, and the unseal confirmation parts 30A and 30B of the fourth embodiment, these embodiments have dealt with the cases of obtaining the condition in which these unseal confirmation parts cannot be stuck again after being removed from the container main body 2 once by applying weak viscosity glue onto their back surfaces. However, glue having strong sticking power can be applied with the seal member for protecting against tampering, such as once it is detached, pattern or character appears (such as "SuperStik" (trade mark) of Lintec Corporation of Japan or a seal for protecting against tampering of 3M Company of the U.S.A.). As a result, the user can confirm at first sight that the drink container 1 has been used or tampered.

In this connection, regarding this type of seal member for protecting against tampering, glue is applied to the back surface of the seal material so as to form a pattern or character part. And when the seal member is peeled off from the container main body 2, the pattern or character part remains on the container main body 2 and are visible from the outside of the seal member.

As described above, the seal member for protecting against tampering has been used for the unseal confirmation part. However, provided that this seal member for protecting against tampering is used as the adhesive seal parts 8A, 8AX, 46, the same effects as those of the above can be obtained.

(8-5) The first, the second, the fifth, the sixth and the seventh embodiments have dealt with the cases of connecting the adhesive seal part 8A to the cohesive parts 8B1, 8B2, 35A, and 35B so that they can be cut off from each other by the straight line perforations 11A and 11B. However, as the connecting means, if the thin straight line cutting groove can be formed instead of perforations, or zigzag perforations or cutting groove can be formed, the same effect as those of the above can be obtained.

As the cutting groove, such as 0.2 (mm) thick groove line can be formed on the 0.5 (mm) thick seal.

(8-6) The embodiments described above have dealt with the cases of providing the sealing seal 8, 46 between the container main body 2, 41 and the seal opener 4, 44. However, instead of this, if the sealing seal 8, 46 is attached to the container main body 2, 41 so as to cover the upper side of the seal opener 4, 44, the same effect as those of the above can be obtained.

(8-7) The embodiments described above have dealt with the cases of providing the knob 12, 50 as the means for peeling off the sealing seal 8, 46. However, the knob 12, 50 can be omitted.

In this case, the user can peel off the sealing seal 8, 46 from the container main body 2, 41 by holding the edge part of the sealing seal.

(8-8) The second embodiment has dealt with the case of proving only one unseal confirmation part 21 of which its back surface is not attached with glue. However, if the plural number of unseal confirmation parts are provided along the perforations, the same effect as those of the above can be obtained.

(8-9) The third and the fourth embodiments have dealt with the cases of providing the unseal confirmation parts 25, 30A, 30B on a part of the adhesive seal part 8A. However, instead, the unseal confirmation parts can be provided on the whole surface of periphery, or can be provided in place of the unseal confirmation part 21 of FIG. 4.

(8-10) The first to the fifth embodiments have dealt with the cases of providing the sealing seal 8 on a part of upper surface plate 3 of the container main body 2. However, the sealing seal 8 can be provided so as to cover the whole upper surface plate 3.

Figure 11:
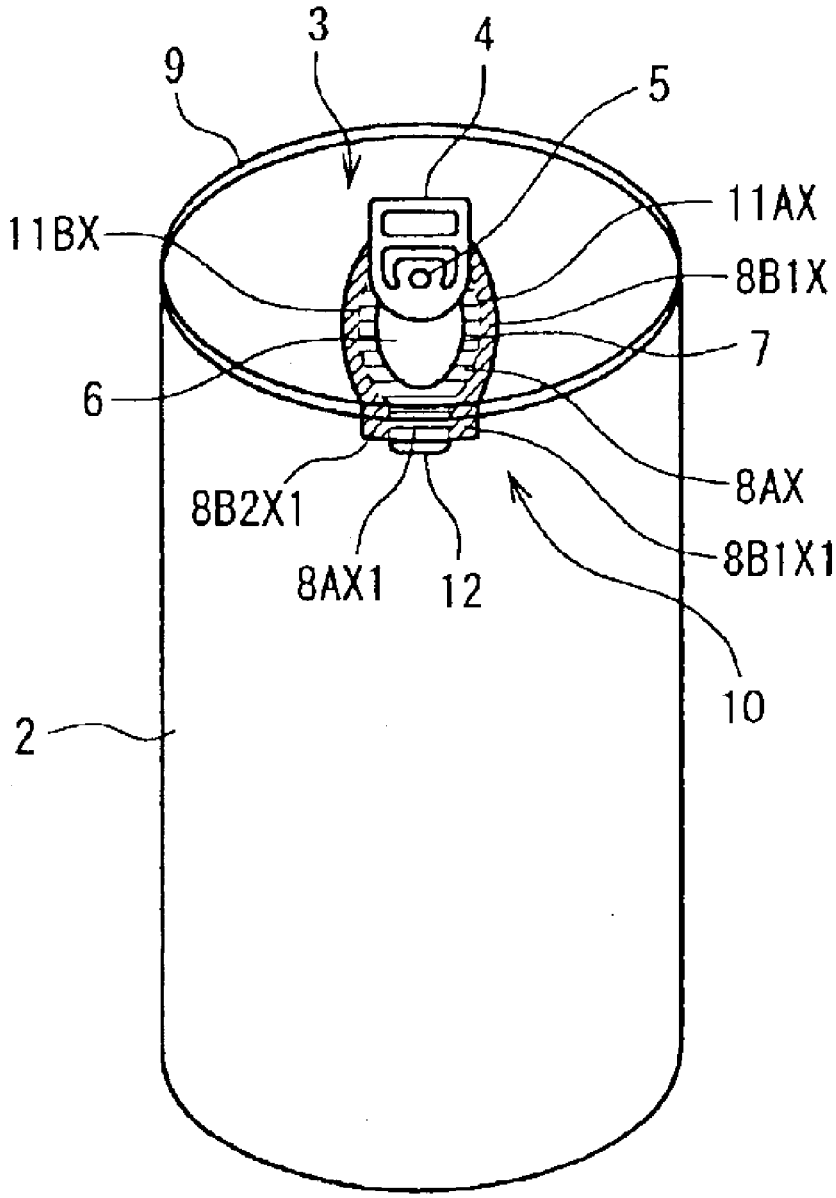
FIG. 11 is a perspective view showing a modified example of FIG. 8.

(8-11) The sixth embodiment (FIG. 8) has dealt with the case of providing the adhesive seal part 8AX and the cohesive part 8B1X, 8B2X on the upper surface plate 3 and providing the knob 12 on its outer edge so as to project outward from the fringe projecting part 9. However, as shown in FIG. 11B, extended parts 8AX1, 8B1X1, 8B2X1 extending to the side surface plate 10 of the container main body 2 crossing over the fringe projecting part 9 can be provided as the adhesive seal part 8AX and the cohesive parts 8B1X, 8B2X, and the knob 2 can be provided on the tip edge of the extended part 8AX1.

According to the foregoing arrangements, as well as the same effect as those of FIG. 6 can be obtained, the part to which the user touches his mouth in the vicinity of drinking mouth 7 can keep clear by the extended part 8AX1.

(8-12) The seventh embodiment (FIGS. 9 and 10) has dealt with the case of providing the cohesive part 46B at the tip of the fringe crimped part 46A1 provided to cover the fringe projecting part 47 of the container main body 41 via the perforation 49. However, the perforation 49 and the cohesive part 46B can be omitted, and in place of these, the unseal confirmation part in which weak viscosity glue is applied on its back surface can be provided along the periphery of the fringe projecting part 47.

With this arrangement, if the sealing seal 47 is opened once and the adhesive seal part 46A is reattached, the unseal confirming part around this adhesive seal part 46A cannot be stuck to the container main body 41 again. Thus, the evidence that the tampering work has been conducted can be clearly seen at first sight.

(8-13) The first, the second, the fifth, the sixth and the seventh embodiments have dealt with the cases of forming the perforations 11A, 11B, 49 on the border between the adhesive seal part 8A, 4A and the cohesive part 35A, 35B, 46B in a straight line. However, its shape is not only limited to the straight line but also it can be formed in a zigzag line such as the saw-toothed waves.

Thus, even if the cohesive parts 35A and 35B are narrow, patterns having special features remain on the edge of the adhesive seal part 8A when the tampering work has been conducted. And thus, the user can confirm the evidence that the tampering work has been conducted at first sight.

According to the present invention as described above, since the unseal confirming member to remain the mark on the drink/food container clearly when the sealing seal which is provided so as to cover the drinking mouth of the drink container or unseal cutting slit of the can container is peeled off even once. Thereby the occurrence of the secondary accident caused by the unauthorized tampering work to the drink/food container can be easily prevented.

Industrial Applicability

The present invention can be applied to drink containers for alcohol such as beer, beverages such as sports drink, coffee and the like, and can containers

What is claimed is:

1. A drink container comprising:

an adhesive seal member provided on a surface of a container main body so as to cover a drinking mouth cover part that is opened by a drinking mouth opener; and an unseal confirmation member for showing that said drink container is in a used condition, by changing a condition of said unseal confirmation member when said adhesive seal member is peeled off once and reattached, wherein:

said adhesive seal member is provided between the surface of said container main body and said drinking mouth opener, so that the adhesive seal member keeps covering a drinking mouth when said drinking mouth cover part is opened by said drinking mouth opener; and said container main body is a can having said drinking mouth cover part on an upper surface plate, and a fringe of said adhesive seal member attached on said drinking mouth cover part with sticky glue is connected to a cohesive seal member via said unseal confirmation member having perforations, and when said adhesive seal member is peeled off, said perforation is torn off and the used condition is shown.

2. The drink container according to claim 1, further comprising a weak viscosity unseal confirmation member placed on an edge of said adhesive seal member and stuck to a surface of said container main body before said adhesive seal member is peeled off, wherein said weak viscosity unseal confirmation member is peeled off together with said adhesive seal member when said adhesive seal member is peeled off, and cannot be stuck to said container main body when said adhesive seal member is reattached.

3. The drink container according to claim 2, wherein said unseal confirmation member leaves letters or marks on said container main body when being peeled off the container main body.

4. The drink container according to claim 1, further comprising an unseal confirmation part that touches said perforations and is a part of said cohesive seal member of which a back surface has no glue so as not to be stuck to said container main body.

5. A can container comprising:

a seal for sealing to cover an upper part of a container main body, wherein said seal for sealing is provided between an upper surface plate of said container main body and an opener, and is unsealed together with said upper surface plate when said upper surface plate is opened along a unseal cutting slit by said opener and simultaneously, a fringe of said upper surface plate is covered by a fringe folded part, and then when said upper surface plate is returned so as to cover said unseal cutting slit, said fringe folded part is reattached to the fringe of said container main body.

* * * * *